US006217161B1

(12) United States Patent
Inose et al.

(10) Patent No.: US 6,217,161 B1
(45) Date of Patent: Apr. 17, 2001

(54) INK STORING CHAMBER STRUCTURE IN AN INK JET PRINTER HEAD

(75) Inventors: Toshio Inose; Masaaki Deguchi, both of Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/095,660

(22) Filed: Jun. 11, 1998

(30) Foreign Application Priority Data

Jun. 18, 1997 (JP) ..... 9-160972

(51) Int. Cl.[7] ..... B41J 2/045
(52) U.S. Cl. ..... 347/71; 347/65
(58) Field of Search ..... 347/65, 70–72, 347/68, 69, 94, 20

(56) References Cited

U.S. PATENT DOCUMENTS

| | | | | |
|---|---|---|---|---|
| 4,568,953 | * | 2/1986 | Aoki et al. | 347/65 |
| 4,897,674 | * | 1/1990 | Hirasawa | 347/65 |
| 4,905,017 | * | 2/1990 | Sugitani et al. | 347/65 |
| 5,708,466 | * | 1/1998 | Noguchi | 347/65 |
| 5,719,606 | * | 2/1998 | Kigawa et al. | 347/68 X |
| 5,896,149 | * | 4/1999 | Kitahara et al. | 347/65 X |
| 5,971,527 | * | 10/1999 | Peeter et al. | 347/65 |
| 6,053,599 | * | 4/2000 | Meada | 347/65 |

FOREIGN PATENT DOCUMENTS

| | | | | |
|---|---|---|---|---|
| 3-81155 | * | 4/1991 | (JP) | 347/94 |
| 3277550 | * | 12/1991 | (JP) | 347/65 |

* cited by examiner

*Primary Examiner*—Benjamin R. Fuller
*Assistant Examiner*—C Dickens
(74) *Attorney, Agent, or Firm*—Oliff & Berridge, PLC

(57) ABSTRACT

An ink jet printer head for discharging ink is provided with: a cavity plate prescribing (i) an ink flow path through which the ink is supplied, (ii) a plurality of ink storing chambers, each of which is connected to the ink flow path in which the supplied ink is temporarily stored, and (iii) a plurality of ink discharge holes which are connected to respective one of the ink storing chambers though which the temporarily stored ink is discharged; a piezoelectric element member, which is shaped in a plate opposed to the cavity plate and has a plurality of piezoelectric elements for selectively changing capacities of the ink storing chambers; and a partition plate interposed between the cavity plate and the piezoelectric element member such that each of the ink storing chambers be a closed space for temporarily storing the ink. The cavity plate is provided with a main plate portion and a plurality of partition wall portions, which stand from the main plate portion and are arranged at substantially equidistant intervals, for partitioning the ink storing chambers adjacent to each other. Each of the partition wall portions includes (i) a straight wall portion, which is disposed at a tip side thereof and is constant in width from the tip side toward a root side thereof to prescribe a straight wall substantially perpendicular to the main plate portion, and (ii) an inclined wall portion, which is disposed at the root side, increases in width from the tip side toward the root side to prescribe an inclined wall oblique to the main plate portion.

13 Claims, 5 Drawing Sheets

INK STORING CHAMBER STRUCTURE IN AN INK JET PRINTER HEAD

BACKGROUND OF THE INVENTION

1. Field of the Invention

The present invention relates to an ink jet printer head.

2. Description of the Related Art

There is an actuator of a head equipped in an ink jet printer, which expands and restores the capacity of many ink storing chambers formed inside the actuator using a piezoelectric element installed corresponding to each of the ink storing chambers, and which applies pressure to the ink inside the ink storing chamber. In this way, the actuator discharges the ink from an ink discharge hole formed in each of the ink storing chambers to the external i.e., onto the recording sheet.

As one example of such an actuator, this is an actuator provided with: a cavity plate in which the ink storing chambers and ink flow paths to supply the ink to the ink storing chambers are formed; and a nozzle plate in which fine ink discharge holes are formed.

The ink discharge holes may be arranged tandem in two rows along a longitudinal direction of the cavity plate at a central surface portion of the cavity plate. Along this tandem direction of the ink discharge holes, two ink flow paths are formed on both peripheral surface portion of the cavity plate. The ink storing chambers store the ink supplied from these ink flow paths, and introduce the ink to the ink discharge holes, such that a plurality of grooves connecting the ink flow paths with the ink discharge holes are arranged along the tandem direction of the ink discharge holes.

These ink storing chambers are separated from each other by respective one of separating walls, each of which is called as a beam. By accurately keeping the width, the height and the arrangement interval (the pitch) of the beam to be predetermined values respectively, the variations of the capacities of the ink storing chambers can be reduced, and that the ink discharge ability can be improved.

However, since the above mentioned cavity plate is formed by injection-molding ceramic such as alumina and then sintering the ceramic, it is necessary to apply a polishing process after the molding and sintering processes, so that it is difficult to keep the width, the height and the arrangement interval of the beam to be predetermined values respectively.

Namely, in a case of forming the beam in a perpendicular wall shape, since the physical or mechanical strength at a root portion of the beam is weak enough to be easily broken, the beam is formed with a certain taper angle. In such a case, there is raised a problem that the width of the beam is changed by the polishing amount.

Further, in a case of fixing the cavity plate onto the piezoelectric element member, it is necessary to adhere a partition plate called as a diaphragm on the cavity plate. In such a case, there is raised a problem that the adhesive agent coated on the beam tends to flow into the grooves from the beam in the taper shape, and the capacity of the ink storing chamber is reduced.

SUMMARY OF THE INVENTION

Given these circumstances, it is an object of the present invention to provide an ink jet printer head, in which the physical strength of the beam can be improved, in which the beam can be accurately formed and in which the adhesive agent can be prevented from flowing into the grooves between the adjacent beams.

The above object of the present invention can be achieved by an ink jet printer head for discharging ink provided with: a cavity plate prescribing (i) an ink flow path through which the ink is supplied, (ii) a plurality of ink storing chambers, each of which is connected to the ink flow path in which the supplied ink is temporarily stored, and (iii) a plurality of ink discharge holes which are connected to respective one of the ink storing chambers though which the temporarily stored ink is discharged; a piezoelectric element member, which is shaped in a plate opposed to the cavity plate and has a plurality of piezoelectric elements for selectively changing capacities of the ink storing chambers; and a partition plate interposed between the cavity plate and the piezoelectric element member such that each of the ink storing chambers be a closed space for temporarily storing the ink. The cavity plate is provided with a main plate portion and a plurality of partition wall portions, which stand from the main plate portion and are arranged at substantially equidistant intervals, for partitioning the ink storing chambers adjacent to each other. Each of the partition wall portions includes (i) a straight wall portion, which is disposed at a tip side thereof and is constant in width from the tip side toward a root side thereof to prescribe a straight wall substantially perpendicular to the main plate portion, and (ii) an inclined wall portion, which is disposed at the root side, increases in width from the tip side toward the root side to prescribe an inclined wall oblique to the main plate portion.

According to the ink jet printer head of the present invention, at the time of forming the cavity plate, a polishing process is applied after a molding process such as an injection molding process is applied. On one hand, since the partition wall portion includes the straight wall portion at the tip side thereof and since the polishing process is applied to the straight wall portion (but not to the inclined wall portion), even if there is a certain variation in the polishing amount, the capacities of the ink storing chambers can be kept constant to each other because of the uniform width of the straight wall portion. On the other hand, since the partition wall portion includes the inclined wall portion at the root side thereof, the physical strength of the partition wall portion can be improved and it is possible to prevent the partition wall portion from being broken at the time of performing the polishing process etc. Further, since the surface of the partition wall portion opposed to the piezoelectric element member through the partition plate is the tip surface of the straight wall portion, it is possible to prevent or restrain the adhesive agent coated on this tip surface from flowing into the ink storing chambers.

In one aspect of the ink jet printer head of the present invention, the inclined wall portion has a taper with a predetermined taper angle.

According to this aspect, since the inclined wall portion has the taper, the physical strength of the partition wall portion at the root side can be certainly improved and it is possible to prevent the partition wall portion from being broken at the root side, at the time of performing the polishing process etc.

In another aspect of the ink jet printer bead of the present invention, the inclined wall portion has a curved surface with a predetermined radius of curvature.

According to this aspect, since the inclined wall portion has the curved surface, the physical strength of the partition wall portion at the root side can be certainly improved and it is possible to prevent the partition wall portion from being broken at the root side, at the time of performing the polishing process etc.

In another aspect of the ink jet printer head of the present invention, the cavity plate and the partition plate are adhered to each other by adhesive agent.

According to this aspect, although the cavity plate and the partition plate are adhered by means of the adhesive agent, since the surface of the partition wall portion adhered to the partition plate is the tip surface of the straight wall portion, it is possible to prevent or restrain the adhesive agent coated on this tip surface from flowing into the ink storing chambers.

In this aspect of the ink jet printer head of the present invention, the adhesive agent may be coated on a tip surface of the straight wall portion. In this case, it is certainly possible to prevent or restrain the adhesive agent coated on the tip surface of the straight wall portion from flowing into the ink storing chambers.

In another aspect of the ink jet printer head of the present invention, a tip surface of the straight wall portion is polished.

According to this aspect, since the straight wall portion is polished, the dimension accuracy of each constitutional part of the cavity plate formed by the injection-molding process etc., can be improved, and the flatness of the surface of the cavity plate can be also improved.

In another aspect of the ink jet printer head of the present invention, the partition plate is a diaphragm having elasticity.

According to this aspect, since the partition plate is a diaphragm having elasticity, it is possible to restore the capacity of each of the ink storing chambers after it is shrunk by the piezoelectric element, by virtue of the elasticity of the diaphragm.

In another aspect of the ink jet printer head of the present invention, the cavity plate prescribes an orifice at a vicinity of each of the ink discharge holes, and is provided with a nozzle plate prescribing a plurality of nozzle holes each connected with respective one of the ink discharge holes.

According to this aspect, the ink can be discharged efficiently from each of the ink storing chambers through the orifice and the ink discharge hole, and can be further discharged at a high velocity through the nozzle hole of the nozzle plate.

The nature, utility, and further features of this invention will be more clearly apparent from the following detailed description with respect to preferred embodiments of the invention when read in conjunction with the accompanying drawings briefly described below.

DETAILED DESCRIPTION OF THE PREFERRED EMBODIMENT

A preferred embodiment for the present invention is explained with reference to the drawings.

Figure 1:
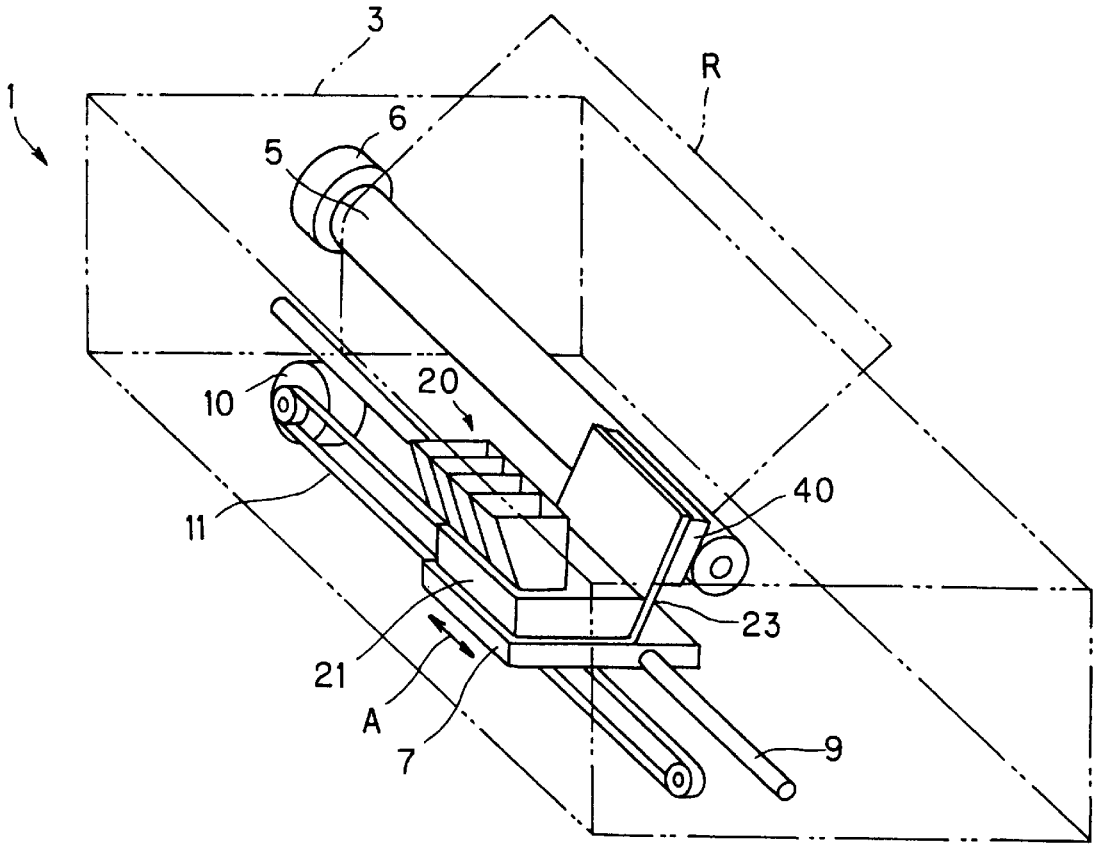
FIG. 1 is a perspective view showing the internal of an ink jet printer 1 according to an embodiment of the present invention.

FIG. 1 is a perspective view showing the internal of an ink jet printer (hereafter, this may be also called simply as a printer) 1 according to an embodiment of the present invention.

In FIG. 1, the printer 1 is provided with a transport roller 5, which is driven by a transport motor 6, for transporting a recording paper R, as one example of a recording medium to be recorded with, toward an upper side of the printer 1 in a frame body 3 thereof. A head 20 supported by a carriage 7 is installed in the transport path of the recording paper R. Moreover, a supporting member 9 that is fixed on the frame body 3 supports the carriage 7 movably in the back and forth directions indicated by an arrow A orthogonal to the transport direction of the recording paper R. In addition, a timing belt 11 which the carriage motor 10 drives fixes the carriage 7, enabling the carriage 7 to move freely the back and forth directions indicated by the arrow A.

The head 20 is provided with: ink tanks 21 for storing inks of four colors (i.e., yellow, magenta, cyan, and black); ink discharging actuators 40 for discharging the inks of four colors; and a front panel 23 for transporting the ink from the respective ink tanks 21 to the corresponding actuators 40.

Figure 2:
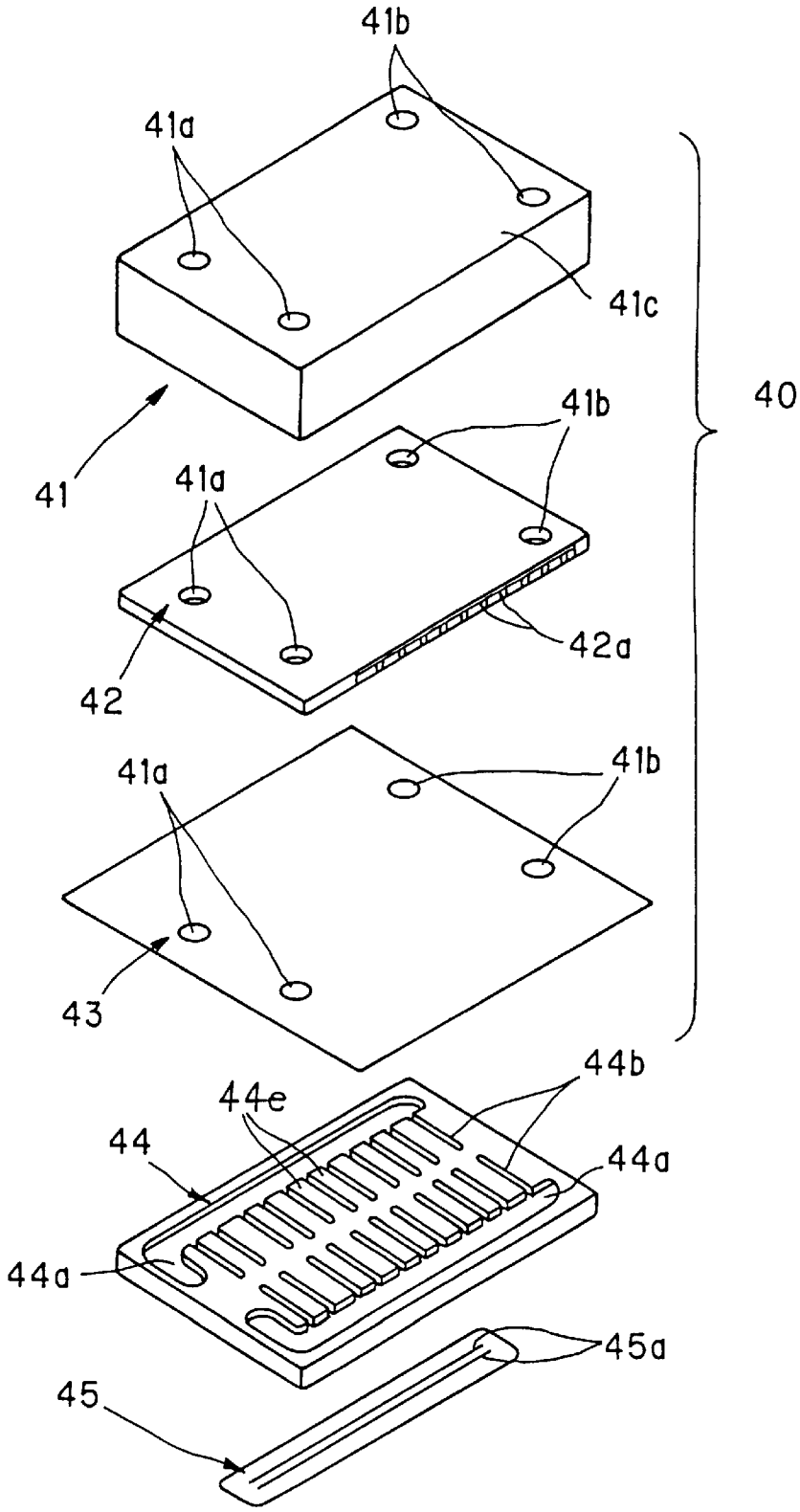
FIG. 2 is a perspective separation view showing an actuator 40 of the printer 1 according to the embodiment of the present invention.

As shown in FIG. 2, each of the actuators 40 is provided with a base 41, a piezoelectric element member 42, and a diaphragm 43.

The base 41 supports each of the above-described components of the actuator 40.

Figure 3:
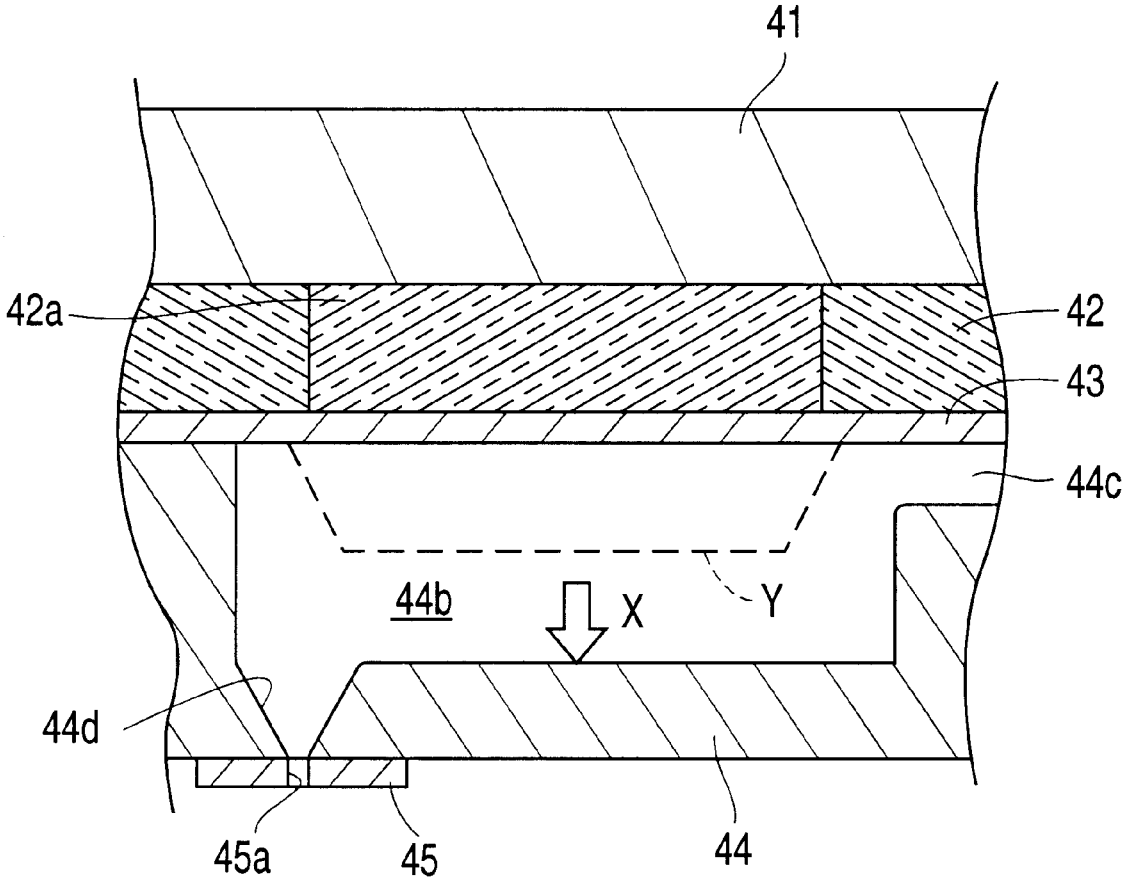
FIG. 3 is a vertical cross sectional view showing a vertical cross section of the actuator 40 of the printer 1 according to the embodiment of the present invention.

The piezoelectric element member 42 is provided with a large number (e.g., 128) of piezoelectric elements 42*a*, so as to expand and shrink individually each of the ink storing chambers 44*b* of the cavity plate 44. When the driving voltage is applied to respective one of the piezoelectric elements 42*a*, the piezoelectric element 42*a* expands in the direction indicated by an arrow X, so as to shrink the capacity of the ink storing chamber 44*b* as indicated by a broken line Y, as shown in FIG. 3 which is a vertical cross sectional view of the actuator 40. Then the driving voltage is released, the piezoelectric element 42*a* restores or returns to its original initial state by the elasticity of the diaphragm 43.

The diaphragm 43 separates the piezoelectric element member 42 from the cavity plate 44, and has elasticity.

The cavity plate 44 has two L-shaped ink flow paths 44*a*, and ink storing chambers 44*b* that branch out perpendicularly from the ink flow paths 44*a*. The number of the ink storing chambers 44*b* is equal to the number of the ink discharge holes 45*a*. Each of the ink storing chambers 44*b* is connected to the respective one of the ink discharge holes 45*a*. Further, as shown in FIG. 3, each of the ink storing chambers 44*b* formed on the cavity plate 44 is connected to respective one of the ink flow paths 44*a* via a connecting path 44*c*. An orifice 44*d* for leading to the respective ink discharge hole 45*a* is formed at the bottom of the ink storing chamber 44*b*.

The nozzle plate 45 is a flat plate on which a large number (e.g., 128) ink discharge holes 45*a* are arranged in two rows respectively.

Incidentally, two forward paths 41*a* and two backward paths 41*b* for circulating the ink from the ink tank 21 in FIG. 1 through the ink flow paths 44*a* penetrate through the base 41, the piezoelectric element 42, and the diaphragm 43.

Next, an operation of discharging the ink from the actuator 40 of the head 20, that is constructed in the above-described manner, will be explained with reference to FIG. 1 to FIG. 3.

The ink is compressed and fed from the ink tank 21 (shown in FIG. 1) to the pair of the ink flow paths 44*a* passing through the pair of forward paths 41*a*, and fills the ink flow path 44*a* (shown in FIG. 2). By releasing the driving voltage, the original state of the piezoelectric element 42*a* is restored. The ink is then guided through the ink flow path 44*a* and the connecting path 44*c*, to be thereby drawn into the ink storing chamber 44*b*. Thus, the ink storing chamber 44*b* is filled with the ink.

Then, by applying the driving voltage to the piezoelectric element 42*a* so as to shrink the capacity of the ink storing chamber 44*b*, the ink is guided through the orifice 44*d* to the ink discharge hole 45*a*, and is discharged outside of the ink storing chamber 44*b*.

By this ink discharge operation of the actuator 40, the ink is discharged from the actuator 40 onto the recording paper R.

Therefore, in order to keep the discharging abilities constant as for all of the ink discharge holes 45*a*, it is necessary to keep the capacities of the ink storing chambers 44*b* constant to each other. This capacity of the ink storing chamber 44*b* is prescribed by the width and the height of the beam 44*e* as a partition wall for partitioning the adjacent ink storing chambers, as shown in FIG. 2.

Figure 4A:
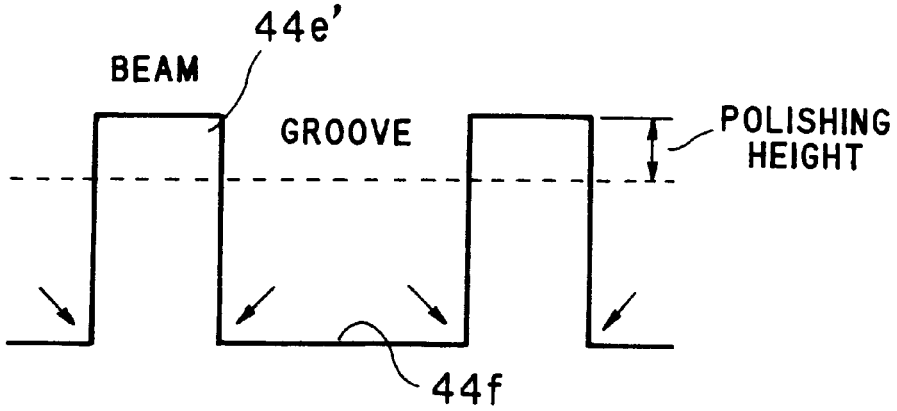
FIG. 4A is a vertical cross sectional view of a beam and a partition wall of one comparison example.
Figure 4B:
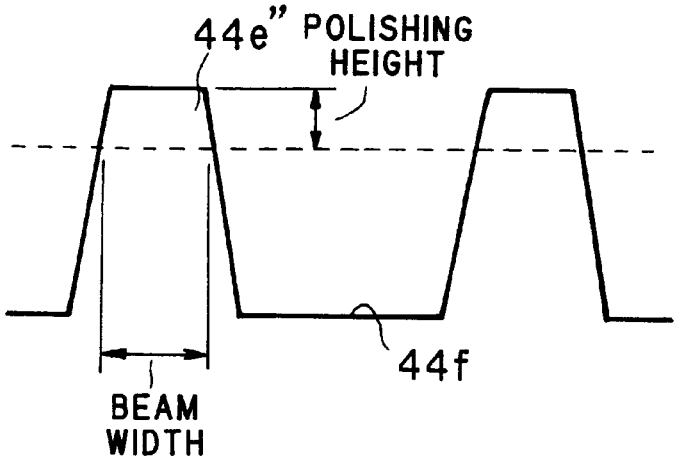
FIG. 4B is a vertical cross sectional view of a beam and a partition wall of another comparison example.

As shown in FIG. 4A, in order to keep the widths of the beams 44*e* constant to each other, it may be proposed to form each beam 44*e′* in a perpendicular wall shape. Incidentally, each of FIG. 4A and FIG. 4B is a vertical cross sectional view of the ink storing chamber 44*b* in the longitudinal direction of the cavity plate 44, in comparison examples.

Since each beam 44*e′* is formed in the perpendicular wall shape as shown in FIG. 4A, there is such an advantage that the widths of the beams 44*e* are kept constant to each other even if there is a variation to some extent in the polishing amount when performing the polishing process with a polishing height.

The purpose of performing the polishing process is to obtain the dimension accuracy of each constitutional part of the cavity plate 44 formed by the injection-molding process, and also to improve the flatness of the surface of the cavity plate 44 i.e. the flatness of the upper surface of the beams 44*e′* to be adhered to the flat surface of the diaphragm 43. On the other hand, as for the bottom surface of the grooves 44*f* of the cavity plate 44, since it is not possible to apply the polishing process thereto, the flatness thereof is achieved by the injection-molding process and the sintering process. However, the requirement for the flatness of the bottom surface of the grooves 44*f* is not so severe as the case of the beams 44*e′* of the cavity plate 44. Thus, the flatness of the bottom surface of the grooves 44*f* does not cause any practical problem.

However, in the case of the beam 44*e′* in the perpendicular wall shape as shown in FIG. 4A, since the physical strength of the root portion of the beam 44*e′* as indicated by each arrow in FIG. 4A, is so week that it may be easily broken at the root portion when performing the polishing process, which is a problem.

Thus, in order to solve this problem, it may be proposed to form a beam 44*e″* having a taper with a certain taper angle as shown in FIG. 4B. In the case of the beam 44*e″* in this shape having the taper, it is possible to improve the physical strength of the root portion of the beam 44*e″* high enough to prevent the root portion from being easily broken when performing the polishing process.

However, in the case of the beam 44*e″* in this shape having the taper, since the width of the beam 44*e* is changed depending on the polishing amount, if there is a variation in the polishing amount, a variation in the capacity of each of the ink storing chambers 44*b* is caused, which is another problem.

Figure 4C:
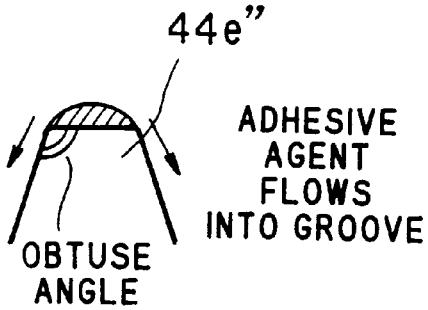
FIG. 4C is a schematic diagram showing a problem when applying the adhesive agent onto the partition wall of FIG. 4B.

Further, if the adhesive agent is coated on the upper surface of the beam 44*e″* in this shape having the taper, the adhesive agent on the rather narrow upper surface of the beam 44*e″* tends to flow into the groove 44*f*, which inclined at the obtuse angle with respect to the upper surface as shown in FIG. 4C. Thus, by the existence of the adhesive agent flown in the groove, the capacity of the ink storing chamber 44*b* is reduced, which is another problem.

Figure 5:
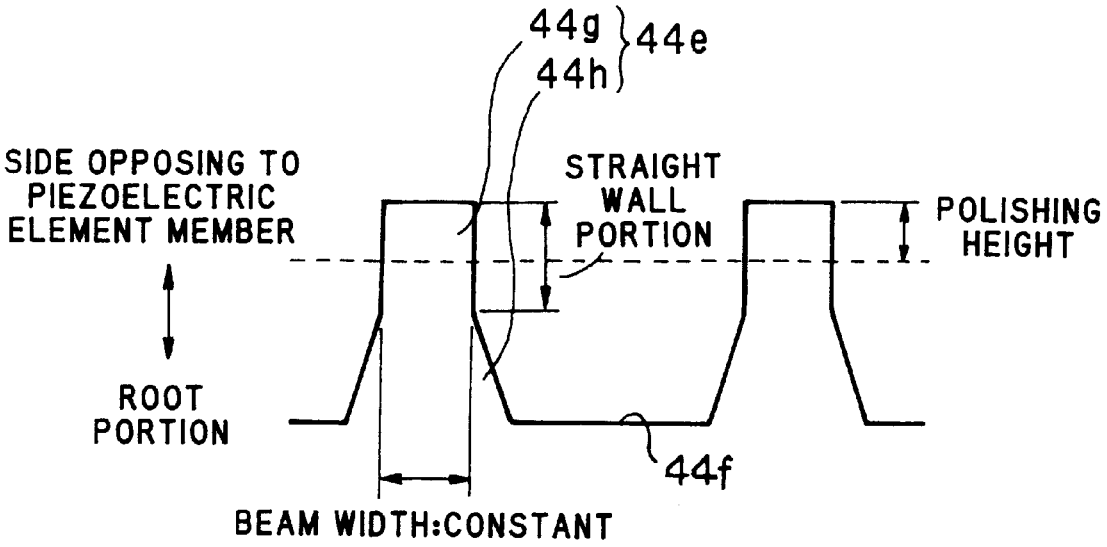
FIG. 5 is a vertical cross sectional view of a beam and a partition wall in one example according to the present embodiment.

Therefore, as shown in FIG. 5, in the present embodiment, the beam 44*e* is formed in such a shape that a straight wall portion 44*g*, which does not have a taper, is located on an upper side of an inclined wall portion 44*h*, which has a taper of a certain taper angle.

According to the structure shown in FIG. 5, since the vertical length of the straight wall portion 44*g* is set longer than the polishing height, even if there is a variation in the polishing amount, it is possible to keep the beam widths constant to each other.

On the other hand, since the inclined wall portion 44*h* which is located at the root portion of the beam 44*e* has a taper with a certain taper angle, the physical strength at the root portion of the beam 44*e* is certainly improved depending on the magnitude of the taper angle, so that the beam 44*e* is hard to be broken.

Further, since the adhesive agent is coated on the upper surface of the straight wall portion 44*g*, the adhesive agent is hard to flow into the groove, so that it is possible to prevent the adhesive agent from reducing the capacity of the ink storing chamber 44*b*.

As described above, according to the present embodiment, it is possible to uniform the beam widths after the polishing process, and at the same time, it is possible to keep the strengths at the root portions of the beams 44*e* high enough not to be easily broken. Further, it is possible to certainly prevent the adhesive agent from flowing into the groove. Thus, it is possible to reduce the variation in the capacity of each of the ink storing chambers 44*b*, so that it is possible to reduce the variation in the ink discharging ability of each of the ink discharge holes 45*a*.

Figure 6:
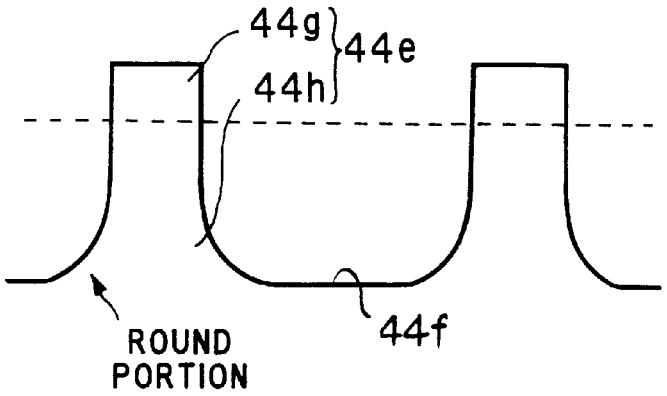
FIG. 6 is a vertical cross sectional view of a beam and a partition wall in another example according to the present embodiment.

In the above described embodiment, although the taper is formed at the root portion of the beam 44*e*, the present invention is not limited to this. For example, as shown in FIG. 6, by forming an inclined wall portion 44*h* at the root portion to be shaped in a round shape, the effect same as that in the above described embodiment can be achieved.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. An ink jet printer head for discharging ink comprising:

a cavity plate prescribing (i) an ink flow path through which the ink is supplied, (ii) a plurality of ink storing chambers, each of which is connected to the ink flow path in which the supplied ink is temporarily stored, and (iii) a plurality of ink discharge holes which are connected to respective ones of the ink storing chambers through which the temporarily stored ink is discharged; and a piezoelectric element member, which is shaped in a plate opposed to said cavity plate and has a plurality of piezoelectric elements for selectively changing capacities of the ink storing chambers, said cavity plate comprising a main plate portion and a plurality of partition wall portions, which stand from said main plate portion and are arranged at substantially equidistant intervals, for partitioning the ink storing chambers adjacent to each other, each of said partition wall portions having a root side attached to the main plate portion and a tip side positioned away from the root side, each partition wall comprising (i) a straight wall portion, which is disposed at the tip side and is constant in width from the tip side toward the root side to prescribe a straight wall substantially perpendicular to said main plate portion, and (ii) an inclined wall portion, which is disposed at the root side and increases in width from the tip side toward the root side to prescribe an inclined wall oblique to said main plate portion.

2. An ink jet printer head according to claim 1, wherein said inclined wall portion has a taper with a predetermined taper angle.

3. An ink jet printer head according to claim 1, wherein said inclined wall portion has a curved surface with a predetermined radius of curvature.

4. An ink jet printer head according to claim 1, wherein a tip surface of said straight wall portion is polished.

5. An ink jet printer head according to claim 1, wherein said cavity plate prescribes an orifice at a vicinity of each of the ink discharge holes, and is provided with a nozzle plate prescribing a plurality of nozzle holes each connected with respective one of the ink discharge holes.

6. An ink jet printer head according to claim 1, further comprising a partition plate interposed between said cavity plate and said piezoelectric element member such that each of the ink storing chambers is closed by the partition plate.

7. An ink jet printer head according to claim 6, wherein said cavity plate and said partition plate are adhered to each other by adhesive agent.

8. An ink jet printer head according to claim 7, wherein the adhesive agent is coated on a tip surface of said straight wall portion.

9. An ink jet printer head according to claim 6, wherein said partition plate comprises a diaphragm having elasticity.

10. An ink jet printer head according to claim 1, wherein a direction from said root side to said tip side is perpendicular to said cavity plate.

11. An ink jet printer head for discharging ink comprising:

a cavity plate means for prescribing (i) an ink flow path through which the ink is supplied, (ii) a plurality of ink storing chambers, each of which is connected to the ink flow path in which the supplied ink is temporarily stored, and (iii) a plurality of ink discharge holes which are connected to respective ones of the ink storing chamber through which the temporarily stored ink is discharged; and a piezoelectric element means, which is shaped in a plate opposed to said cavity plate means and has a plurality of piezoelectric elements, for selectively changing capacities of the ink storing chambers, said cavity plate means comprising a main plate portion and a plurality of partition wall portions, which stand from said main plate portion and are arranged at substantially equidistant intervals, for partitioning the ink storing chambers adjacent to each other, each of said partition wall portions having a root side attached to the main plate portion and a tip side positioned away from the root side each partition wall comprising (i) a straight wall portion, which is disposed at the tip side and is constant in width from the tip side toward the root side to prescribe a straight wall substantially perpendicular to said main plate portion, and (ii) an inclined wall portion, which is disposed at the root side and increases in width from the tip side toward the root side to prescribe an inclined wall oblique to said main plate portion.

12. An ink jet printer head according to claim 11, further comprising a partition plate means interposed between said cavity plate and said piezoelectric element member such that each of the ink storing chambers is closed by the partition plate.

13. An ink jet printer head according to claim 11, wherein a direction from said root side to said tip side is perpendicular to said cavity plate means.

* * * * *